US010032411B2

(12) United States Patent
Jeon

(10) Patent No.: US 10,032,411 B2
(45) Date of Patent: Jul. 24, 2018

(54) PIXEL CIRCUIT AND METHOD FOR DRIVING A PIXEL CIRCUIT

(71) Applicant: SAMSUNG DISPLAY CO., LTD., Yongin, Gyeonggi-Do (KR)

(72) Inventor: Jin Jeon, Seoul (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 114 days.

(21) Appl. No.: 15/058,674

(22) Filed: Mar. 2, 2016

(65) Prior Publication Data

US 2016/0260379 A1 Sep. 8, 2016

(30) Foreign Application Priority Data

Mar. 4, 2015 (KR) ..... 10-2015-0030560

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0426* (2013.01); *G09G 2300/0819* (2013.01); *G09G 2300/0842* (2013.01); *G09G 2300/0861* (2013.01); *G09G 2310/062* (2013.01)

(58) Field of Classification Search
CPC ..... B26D 1/0006; B26D 2001/0053; B26B 9/00; B26B 9/02; C23F 1/04
See application file for complete search history.

(56) References Cited

U.S. PATENT DOCUMENTS

2010/0013816 A1* 1/2010 Kwak ..... G09G 3/3233 345/211
2014/0176402 A1* 6/2014 Lee ..... G09G 3/32 345/77

FOREIGN PATENT DOCUMENTS

KR 10-1152466 B1 6/2012
KR 10-1269000 B1 5/2013
KR 10-2013-0091136 A 8/2013
KR 10-2013-0110418 A 10/2013

* cited by examiner

*Primary Examiner* — Shaheda Abdin
(74) *Attorney, Agent, or Firm* — Lee & Morse P.C.

(57) ABSTRACT

A pixel circuit includes a first pixel and a second pixel. The first pixel includes a first transistor to control current to a first light emitter and a second transistor to connect the first light emitter to first reset power. The second pixel includes a third transistor to control current to a second light emitter and a fourth transistor to connect the second light emitter to the first reset power. The second and fourth transistors are controlled by a same control signal.

11 Claims, 8 Drawing Sheets

PIXEL CIRCUIT AND METHOD FOR DRIVING A PIXEL CIRCUIT

CROSS-REFERENCE TO RELATED APPLICATION

Korean Patent Application No. 10-2015-0030560, filed on Mar. 4, 2015, and entitled, "Pixel Circuit and Method for Driving Pixel Circuit Using the Same," is incorporated by reference herein in its entirety.

BACKGROUND

1. Field

One or more embodiments described herein relate to a pixel circuit and a method for driving a pixel circuit.

2. Description of the Related Art

An organic light emitting display generates images based on light emitted from a plurality of pixels. Each pixel emits light from an organic light emitting diode. Light emission is achieved when electrons and holes are injected from electrodes of the diode into an organic emission layer. When the electrons and holes combine in the emission layer, excitons are formed and light is emitted when the excitons fall to ground state.

Because an organic light emitting display does not require an additional light source (e.g., a backlight), this type of display may be thinner and lighter than other types of flat panel displays. Also, organic light emitting displays have fast response speed and excellent light emission efficiency, luminance, and viewing angle. An organic light emitting display is therefore suitable for use in a variety of electronic products, ranging from small portable devices to large televisions and monitors.

Structurally, an organic light emitting diode display may include a data driver for transmitting data signals to data lines, a scan driver for sequentially transmitting a scan signal to scan lines, and a plurality of pixels connected to the scan lines and data lines. Each pixel supplies current based on a data signal to the organic light emitting diode (OLED). The OLED emits light based on the amount of the supplied current.

However, it may be difficult to make an organic light emitting diode display that has high resolution. This is because, for example, the number of scanning lines and reset wires may become excessive at higher resolution levels.

SUMMARY

In accordance with one or more embodiments, a pixel circuit includes a first pixel which includes: a first transistor to allow a first current corresponding to a voltage between a control electrode and a second electrode to flow to a first electrode, the second electrode connected to a first power; a first light-emitting device including a first terminal connected to the first electrode of the first transistor and a second terminal connected to a second power, the first light-emitting device to emit light based on the first current; and a second transistor including a control electrode connected to a first scanning line, a second electrode connected to a first terminal of the first light-emitting device, and a first electrode connected to a first reset power; and a second pixel which includes: a third transistor to allow a second current corresponding to a voltage between a control electrode and a second electrode to flow to a second electrode, the second electrode connected to the first power; a second light-emitting device including a first terminal connected to the first electrode of the third transistor and a second terminal connected to the second power, the second light-emitting device to emit light based on the second current; and a fourth transistor including a control electrode connected to the first scanning line, a second electrode connected to a first terminal of the second light-emitting device, and a first electrode connected to the first reset power.

The first pixel may include a fifth transistor including a control electrode connected to a second scanning line, a second electrode connected to a control electrode of the first transistor, and a first electrode connected to a second reset power, and the second pixel may include a sixth transistor including a control electrode connected to a third scanning line, a second electrode connected to a control electrode of the third transistor, and a first electrode connected to the second reset power. The second scanning line of the first pixel may be connected to the third scanning line of the second pixel.

The first pixel may include a seventh transistor including a control electrode connected to a third scanning line, a second electrode connected to a corresponding data line, and a first electrode connected to a second electrode of the first transistor; and an eighth transistor including a control electrode connected to the third scanning line, a second electrode connected to a control electrode of the first transistor, and a first electrode connected to a first electrode of the first transistor, and wherein the second pixel may include a ninth transistor including a control electrode connected to a fourth scanning line, a second electrode connected to a corresponding data line, and a first electrode connected to a second electrode of the first transistor; and a tenth transistor including a control electrode connected to the fourth scanning line, a second electrode connected to a control electrode of the first transistor, and a first electrode connected to a first electrode of the first transistor.

In accordance with one or more other embodiments, a method is provided for driving a pixel circuit in accordance with the aforementioned embodiment. The method includes applying a first scanning signal to the first scanning line; applying the first reset power to the first terminal of the first light-emitting device; and applying the first reset power to the first terminal of the second light-emitting device.

The second pixel may include a fifth transistor including a control electrode connected to a third scanning line, a second electrode connected to a control electrode of the third transistor, and a first electrode connected to the second reset power, the pixel circuit may include a sixth transistor including a first electrode for receiving a first current corresponding to a voltage between a control electrode and a second electrode, and the second electrode connected to the first power, and a seventh transistor including a control electrode connected to the third scanning line, a second electrode connected to the control electrode of the sixth transistor, and a first electrode connected to the second reset power.

The method may further include applying a third scanning signal to the third scanning line, applying the second reset power to the control electrode of the third transistor, and applying the second reset power to the control electrode of the fifth transistor.

In accordance with one or more embodiments, an apparatus includes a first pixel including a first transistor to control current to a first light emitter and a second transistor to connect the first light emitter to first reset power; and a second pixel including a third transistor to control current to a second light emitter and a fourth transistor to connect the second light emitter to the first reset power, the second and fourth transistors to be controlled by a same control signal. The same control signal may be a first scanning signal. The second and fourth transistors may be connected to a same scanning line to receive the first scanning signal.

The first pixel may include a fifth transistor to connect the first transistor to second reset power and sixth transistor to receive a first data signal, and the second pixel may include a seventh transistor to connect the third transistor to the second reset power and an eighth transistor to receive a second data signal, wherein the fifth transistor is to be controlled by a second scanning signal and the seventh transistor is to be controlled by a third scanning signal, and wherein the first scanning signal the second scanning signal, and the third scanning signal are applied at different times.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
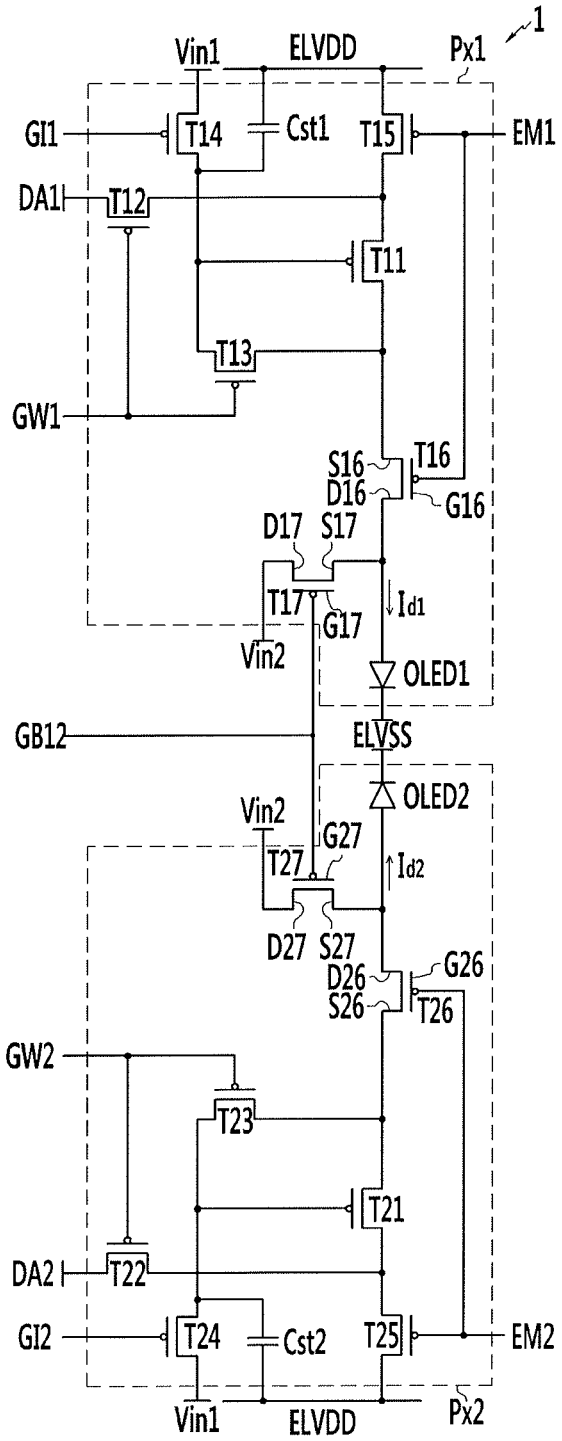
FIG. 1 illustrates an embodiment of a pixel circuit.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

It is to be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

It is to be understood that when one component is referred to as being "connected" or "coupled" to another component, it may be connected or coupled directly to another component or be connected or coupled to another component with the other component intervening therebetween. On the other hand, it is to be understood that when one component is referred to as being "connected or coupled directly" to another component, it may be connected to or coupled to another component without the other component intervening therebetween.

FIG. 1 illustrates an embodiment of a pixel circuit 1 which includes a first pixel PX1 and a second pixel PX2. The first pixel PX1 includes a plurality of transistors, a plurality of wires selectively connected to the transistors, a first capacitor Cst1, and a first organic light emitting diode (OLED1).

The transistors include a first transistor T11, a second transistor T12, a third transistor T13, a fourth transistor T14, a fifth transistor T15, a sixth transistor T16, and a seventh transistor T17. The first transistor T11 includes a gate electrode connected to a drain electrode of the third transistor T13 and a drain electrode of the fourth transistor T14, a source electrode connected to a drain electrode of the second transistor T12 and a drain electrode of the fifth transistor T15, and a drain electrode connected to a source electrode of the third transistor T13 and a source electrode of the sixth transistor T16.

The second transistor T12 includes a gate electrode connected to a first scanning line GW1, a source electrode connected to a data line DA1, and a drain electrode connected to a source electrode of the first transistor T11.

The third transistor T13 includes a gate electrode connected to the first scanning line GW1, a source electrode connected to the drain electrode of the first transistor T11, and a drain electrode connected to the gate electrode of the first transistor T11.

The fourth transistor T14 includes a gate electrode connected to a second scanning line GI1, a source electrode connected to a first reset power supply line Vin1, and a drain electrode connected to the gate electrode of the first transistor T11.

The fifth transistor T15 includes a gate electrode connected to a first emission control line EM1, a source electrode connected to a driving power supply line (ELVDD), and a drain electrode connected to the source electrode of the first transistor T11.

The sixth transistor T16 includes a gate electrode G16 connected to the first emission control line EM1, a source electrode S16 connected to the drain electrode of the first transistor T11, and a drain electrode D16 connected to a source electrode S17 of the seventh transistor T17.

The seventh transistor T17 includes a gate electrode G17 connected to a third scanning line GB12, a source electrode S7 connected to a first electrode of the first organic light emitting diode (OLED1), and a drain electrode D17 connected to a second reset power supply line Vin2.

The plurality of wires include the first scanning line GW1 for transmitting a first scanning signal to the gate electrode of the second transistor T12 and the gate electrode of the third transistor T13, the second scanning line G11 for transmitting a second scanning signal to the gate electrode of the fourth transistor T14, the third scanning line GB12 for transmitting a third scanning signal to the gate electrode G17 of the seventh transistor T17, the first emission control line EM1 for transmitting a first emission control signal to the gate electrode of the fifth transistor T15 and the gate electrode G16 of the sixth transistor T16, and the data line DA1 for transmitting a data signal to the source electrode of the second transistor T12.

The wires also include a driving power supply line (ELVDD) for supplying a driving signal to a first electrode of a first capacitor Cst1 and the source electrode of the fifth transistor T15, the first reset power supply line Vin1 for supplying a first reset signal to the source electrode of the fourth transistor T14, and the second reset power supply line Vin2 for supplying a second reset signal to the drain electrode D17 of the seventh transistor T17.

The first capacitor Cst1 includes a first electrode connected to the driving power supply line (ELVDD), and a second electrode connected to the gate electrode of the first transistor T11 and the drain electrode of the third transistor T3.

The first organic light emitting diode OLED1 includes a first electrode, a second electrode, and an organic emission layer provided between the first electrode and the second electrode. The first organic light emitting diode OLED1 includes the first electrode connected to the source electrode S7 of the seventh transistor T17 and the drain electrode D16 of the sixth transistor T16, and a second electrode connected to a common power supply line (ELVSS) for transmitting a common signal.

The second pixel PX2 includes a plurality of transistors, a plurality of wires selectively connected to the transistors, a second capacitor Cst2, and a second organic light emitting diode (OLED2).

The transistors include an eighth transistor T21, a ninth transistor T22, a tenth transistor T23, an eleventh transistor T24, a twelfth transistor T25, a thirteenth transistor T26, and a fourteenth transistor T27. The eighth transistor T21 includes a gate electrode connected to a drain electrode of the tenth transistor T23 and a drain electrode of the eleventh transistor T24, a source electrode connected to a drain electrode of the twelfth transistor T25 and a drain electrode of the ninth transistor T22, and a drain electrode connected to a source electrode of the tenth transistor T23 and a source electrode of the thirteenth transistor T26.

The ninth transistor T22 includes a gate electrode connected to the fourth scanning line GW2, a source electrode connected to a data line DA2, and a drain electrode connected to the source electrode of the eighth transistor T21.

The tenth transistor T23 includes a gate electrode connected to a fourth scanning line GW2, a source electrode connected to the drain electrode of the eighth transistor T21, and a drain electrode connected to the gate electrode of the eighth transistor T21.

The eleventh transistor T24 includes a gate electrode connected to a fifth scanning line GI2, a source electrode connected to a first reset power supply line Vin1, and a drain electrode connected to the gate electrode of the eighth transistor T21.

The twelfth transistor T25 includes a gate electrode connected to the second emission control line EM2, a source electrode connected to the driving power supply line (ELVDD), and a drain electrode connected to the source electrode of the eighth transistor T21.

The thirteenth transistor T26 includes a gate electrode G26 connected to the second emission control line EM2, a source electrode S26 connected to the drain electrode of the eighth transistor T21, and a drain electrode D26 connected to the source electrode S17 of the fourteenth transistor T27.

The fourteenth transistor T27 includes a gate electrode G17 connected to a third scanning line GB12, a source electrode S7 connected to a first electrode of the second organic light emitting diode OLED2, and a drain electrode D17 connected to the second reset power supply line Vin2.

The wires include the fourth scanning line GW2 for transmitting a fourth scanning signal to the gate electrode of the ninth transistor T22 and the gate electrode of the tenth transistor T23, the fifth scanning line GI2 for transmitting a fifth scanning signal to the gate electrode of the eleventh transistor T24, the third scanning line GB12 for transmitting a third scanning signal to the gate electrode G17 of the fourteenth transistor T27, the second emission control line EM2 for transmitting a second emission control signal to the gate electrode of the twelfth transistor T25 and the gate electrode G26 of the thirteenth transistor T26, and the data line DA2 for transmitting a data signal to the source electrode of the ninth transistor T22.

The wires also include the driving power supply line (ELVDD) for supplying a driving signal to a first electrode of the second capacitor Cst2 and the source electrode of the twelfth transistor T25, a first reset power supply line Vin1 for supplying a first reset signal to the source electrode of the eleventh transistor T24, and a second reset power supply line Vin2 for supplying a second reset signal to the drain electrode D27 of the fourteenth transistor T27.

The second capacitor Cst2 includes a first electrode connected to the driving power supply line (ELVDD) and a second electrode connected to the gate electrode of the eighth transistor T21 and the drain electrode of the third transistor T3.

The second organic light emitting diode OLED2 includes a first electrode, a second electrode, and an organic emission layer provided between the first electrode and the second electrode. The second organic light emitting diode OLED2 includes a first electrode connected to the source electrode S7 of the fourteenth transistor T27 and the drain electrode D26 of the thirteenth transistor T26, and a second electrode connected to the common power supply line (ELVSS) for transmitting the common signal.

Therefore, the first pixel PX1 and the second pixel PX2 may share the third scanning line GB12 and may be driven with the five scanning lines GW1, GI1, GB12, GW2, and GI2.

Figure 2:
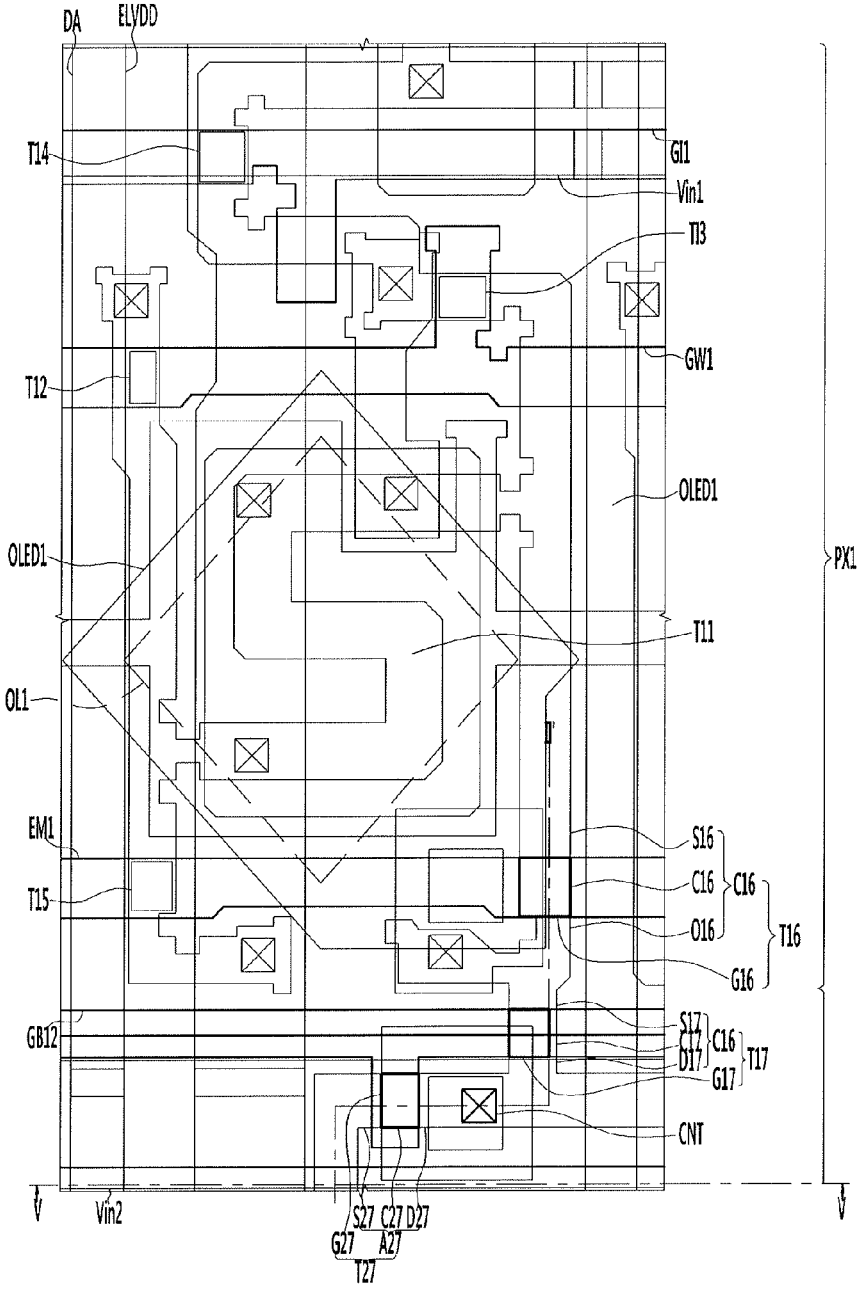
FIGS. 2 and 3 illustrate example layouts of the pixel circuit.
Figure 3:
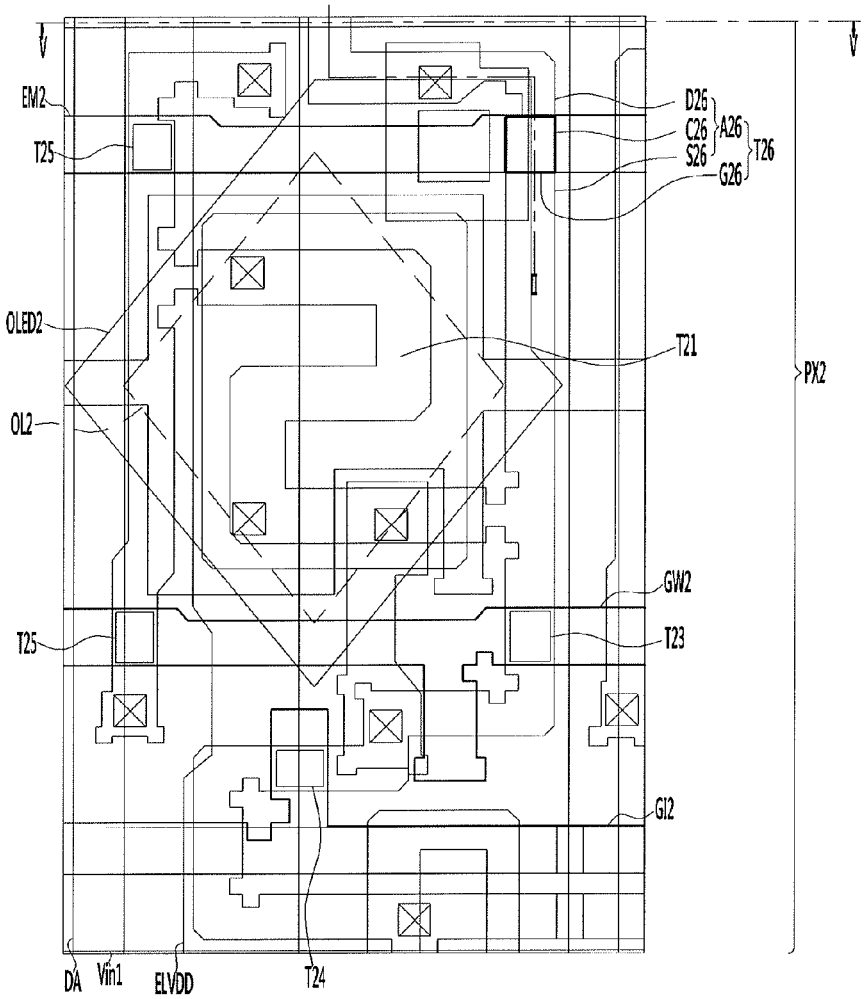
Figure 4:
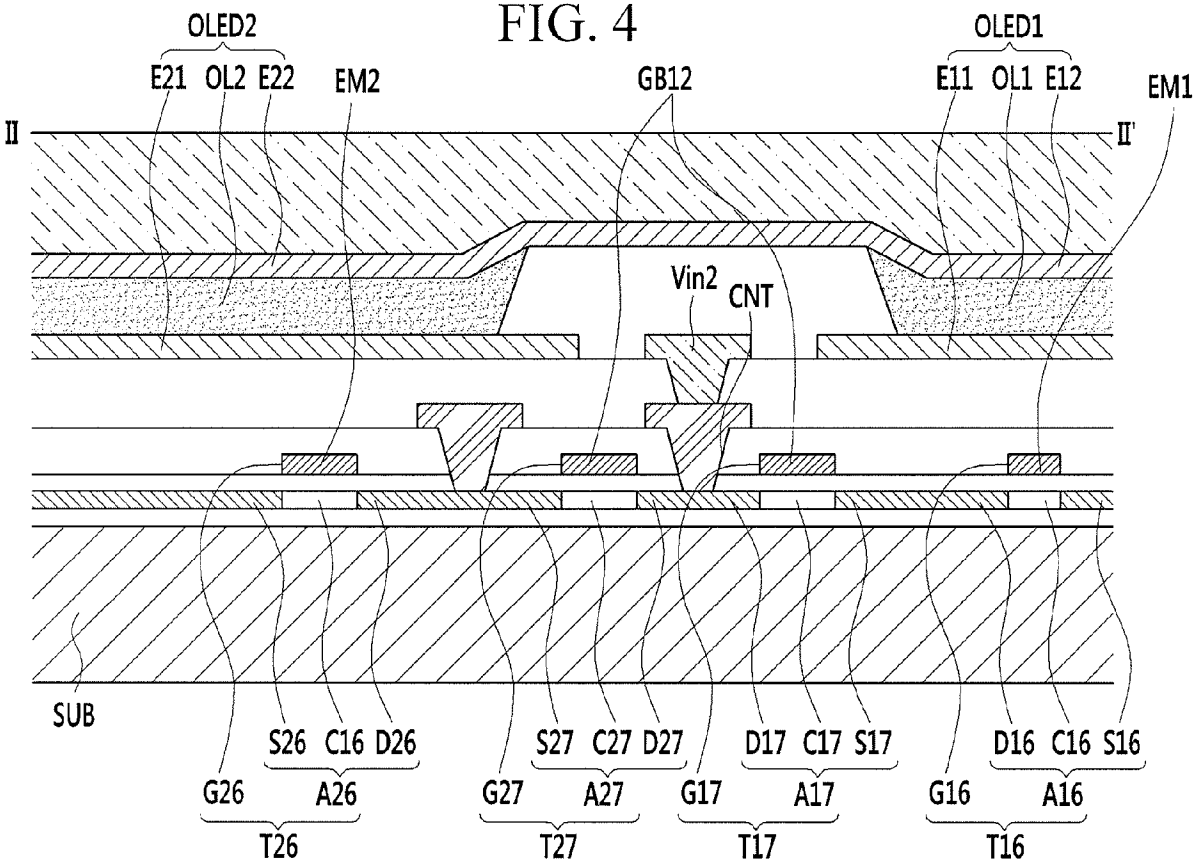
FIG. 4 illustrates a view along section line V-V in FIGS. 2 and 3.

FIG. 2 and FIG. 3 show example layout of the pixel circuit 1 in FIG. 1, and FIG. 4 shows an example of a cross-sectional view taken along line V-V in FIGS. 2 and 3. In these examples, insulating layers are between components positioned on different layers to be described below. The insulating layer may be, for example, an inorganic insulating layer or an organic insulating layer including a silicon nitride, a silicon oxide, or another insulating material. Each of the insulating layers may be a single layer or multiple layers.

Referring to FIGS. 2 and 3, the pixel circuit 1 is divided with respect to a line V-V. The first pixel PX1 includes a substrate SUB, transistors T11-T17, wires GW1, GI1 GB12, EM1, Vin1, Vin2, DA, and ELVDD, first capacitor Cst1, and first organic light emitting diode OLED1. The second pixel PX2 includes substrate SUB, transistors T21-T27, wires GW2, GI2, GB12, EM2, Vin1, Vin2, DA, and ELVDD, second capacitor Cst2, and second organic light emitting diode OLED2.

The configurations for the transistors T11-T15 and the wires GW1, GI1 EM1, DA, and ELVDD of the first pixel PX1 and the transistors T21-T25 and the wires GW2, GI2, EM2, DA, and ELVDD of the second pixel PX2 may correspond to FIG. 1. The substrate SUB may include glass, quartz, ceramic, sapphire, plastic, or metal.

The sixth transistor T16 is on the substrate SUB and includes an active pattern A16 and a gate electrode G16. The active pattern A16 includes a source electrode S16, a channel C16, and a drain electrode D16. The source electrode S16 is connected to the drain electrode of the first transistor T11, and the drain electrode D16 is connected to the first electrode E11 of the first organic light emitting diode (OLED1) through a contact hole. The channel C16 is a channel region of the active pattern A16 overlapping the gate electrode G16, and is between the source electrode S16 and the drain electrode D16.

The channel C16 of the active pattern A16 may be channel-doped with an N-type impurity or a P-type impurity. The source electrode S16 and the drain electrode D16 may be separated from each other with the channel C16 therebetween, and may be doped with a doping impurity opposite in type to the doping impurity of the channel C16.

The active pattern A16 is on a same layer as an active pattern A17, an active pattern A27, and an active pattern A26, may be formed with a same material as the active pattern A17, the active pattern A27, and the active pattern A26, and may be integrally formed with the active pattern A17, the active pattern A27, and the active pattern A26.

The gate electrode G16 is on the channel C16 of the active pattern A16 and is integrally formed with the first emission control line EM1.

The seventh transistor T17 is provided on the substrate SUB and includes an active pattern A17 and a gate electrode G17.

The active pattern A17 includes a source electrode S17, a channel electrode C17, and a drain electrode D17. The source electrode S17 is connected to the first electrode E11 of the first organic light emitting diode OLED1, and the drain electrode D17 is connected to the second reset power supply line Vin2 through a contact hole. The channel C17 is a channel region of the active pattern A17 overlapping the gate electrode G17, and is between the source electrode S17 and the drain electrode D17.

The channel C17 of the active pattern A17 may be channel-doped with an N-type impurity or a P-type impurity. The source electrode S17 and the drain electrode D16 may be separated from each other with the channel C17 therebetween and may be doped with a doping impurity opposite in type to the doping impurity of the channel C17. The active pattern A17 is on a same layer as an active pattern A16, an active pattern A27, and an active pattern A26, may be formed with a same material as the active pattern A16, the active pattern A27, and the active pattern A26, and may be integrally formed with the active pattern A16, the active pattern A27, and the active pattern A26.

The gate electrode G17 is on the channel C17 of the active pattern A17 and is integrally formed with the third scanning line GB12.

The first organic light emitting diode OLED1 includes a first electrode E11, an organic emission layer OL1, and a second electrode E12. The first electrode E11 is connected to the drain electrode D16 of the sixth transistor T16 through a contact hole. The organic emission layer OL1 is between the first electrode E11 and the second electrode E12. The second electrode E12 is on the organic emission layer OL1. At least one of the first electrode E11 or the second electrode E12 may be at least one of a light transmittable electrode, a light reflective electrode, or a light semi-transmittable electrode. The light emitted by an organic emission layer OL1 may be output to at least one electrode direction of the first electrode E11 and the second electrode E12.

A capping layer for covering the first organic light emitting diode (OLED1) may be on the first organic light emitting diode OLED1. A thin film encapsulation layer or an encapsulation substrate may be on the first organic light emitting diode OLED1, with the capping layer therebetween.

The fourteenth transistor T27 includes a substrate SUB, an active pattern A27, and a gate electrode G27.

The active pattern A27 includes a source electrode S27, a channel C27, and a drain electrode D27. The source electrode S27 is connected to the first electrode E21 of the second organic light emitting diode OLED2. The drain electrode D27 is connected to the second reset power supply line Vin2 through a contact hole. The channel C27 is a channel region of the active pattern A27 overlapping the gate electrode G27, and may be between the source electrode S27 and the drain electrode D27.

The channel C27 of the active pattern A27 may be channel-doped with an N-type impurity or a P-type impurity. The source electrode S27 and the drain electrode D26 may be separated from each other with the channel C27 therebetween and may be doped with a doping impurity opposite in type to the doping impurity of the channel C27. The active pattern A27 is on a same layer as an active pattern A26, an active pattern A17, and an active pattern A16, may be formed with a same material as the active pattern A26, the active pattern A16, and the active pattern A17, and may be integrally formed with the active pattern A26, the active pattern A16, and the active pattern A17.

The gate electrode G27 is on the channel C27 of the active pattern A27 and is integrally formed with the third scanning line GB12.

The thirteenth transistor T26 is on the substrate SUB and includes an active pattern A26 and a gate electrode G26.

The active pattern A26 includes a source electrode S26, a channel C26, and a drain electrode D26. The source electrode S26 is connected to the drain electrode of the eighth transistor T21. The drain electrode D26 is connected to the first electrode E21 of the second organic light emitting diode (OLED2) through a contact hole. The channel C26 is a channel region of the active pattern A26 overlapping the gate electrode G26, and may be between the source electrode S26 and the drain electrode D26.

The channel C26 of the active pattern A26 may be channel-doped with an N-type impurity or a P-type impurity. The source electrode S26 and the drain electrode D26 may be separated from each other with the channel C26 therebetween and may be doped with a doping impurity opposite in type to the doping impurity of the channel C26.

The active pattern A26 is on a same layer as an active pattern A27, an active pattern A16, and an active pattern A17, may be formed with a same material as the active pattern A27, the active pattern A16, and the active pattern A17, and may be integrally formed with the active pattern A27, the active pattern A16, and the active pattern A17.

The gate electrode G26 is on the channel C26 of the active pattern A26 and is integrally formed with the second emission control line EM2.

The second organic light emitting diode OLED2 includes a first electrode E21, an organic emission layer OL2, and a second electrode E22. The first electrode E21 is connected to the drain electrode D26 of the thirteenth transistor T26 through a contact hole. The organic emission layer OL2 is between the first electrode E21 and the second electrode E22. The second electrode E22 is on the organic emission layer OL2. At least one of the first electrode E21 and the second electrode E22 may be at least one of a light transmittable electrode, a light reflective electrode, or a light semi-transmittable electrode. The light emitted by an organic emission layer OL2 may be output to at least one electrode direction of the first electrode E21 and the second electrode E22.

A capping layer for covering the second organic light emitting diode OLED2 may be on the second organic light emitting diode OLED2. A thin film encapsulation layer or an encapsulation substrate may be on the second organic light emitting diode OLED2, with the capping layer therebetween.

The third scanning line GB12 is on the active pattern A17 of the seventh transistor T17 and the active pattern A27 of the fourteenth transistor T27, and is integrally formed with the gate electrode G17 of the seventh transistor T17 and the gate electrode G27 of the fourteenth transistor T27.

The second reset power supply line Vin2 is connected to the drain electrode D17 of the seventh transistor T17 and the drain electrode D27 of the fourteenth transistor T27 through a contact hole CNT. The second reset power supply line Vin2 is on the same layer as the first electrode E11 of the first organic light emitting diode OLED1 and the first electrode E21 of the second organic light emitting diode OLED2, and may be formed with a same material.

Figure 5:
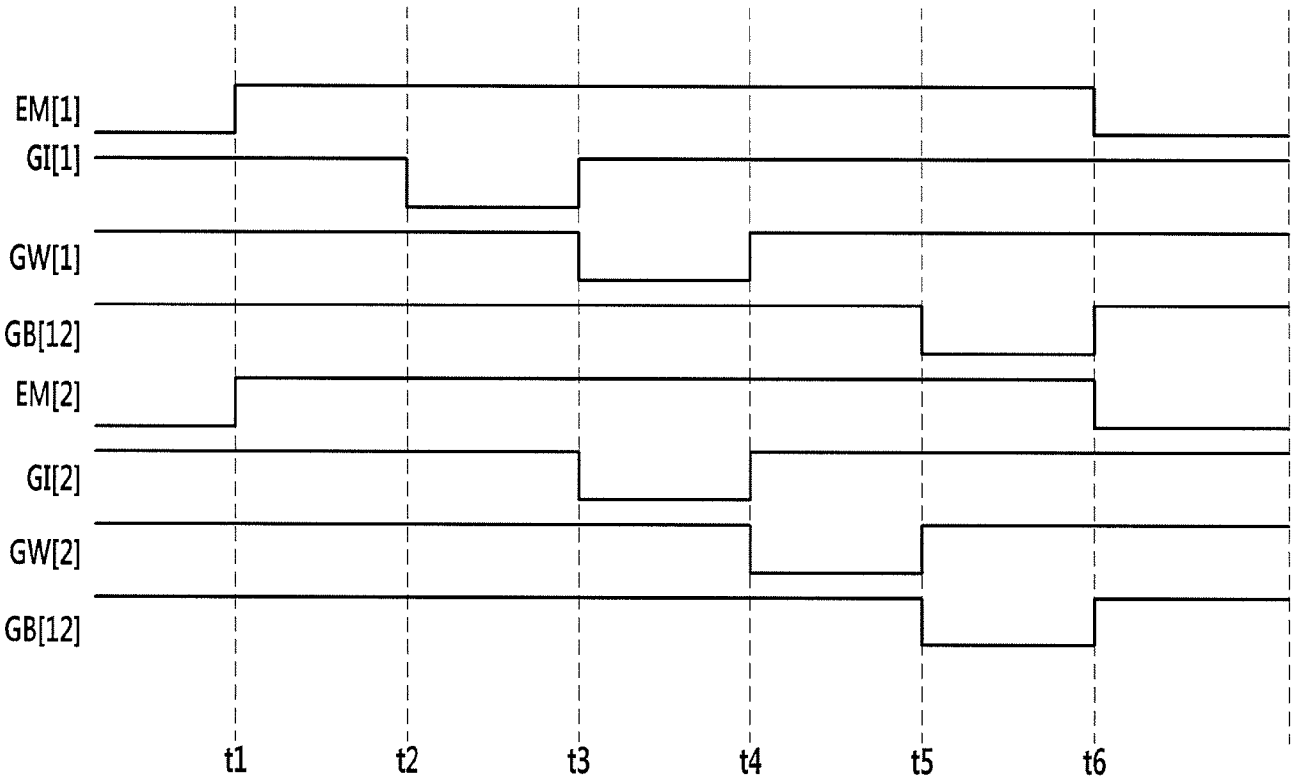
FIG. 5 illustrates an example of control signals for the pixel circuit.

FIG. 5 is a driving timing diagram illustrating an example of control signals for the pixel circuit 1. At time t1, a disable-level first emission control signal EM[1] is applied to the fifth transistor T15 and the sixth transistor T16 to turn off the fifth transistor T15 and the sixth transistor T16. A disable-level second emission control signal EM[2] is applied to the twelfth transistor T25 and the thirteenth transistor T26 to turn off the twelfth transistor T25 and the thirteenth transistor T26.

At time t2, an enable-level second scanning signal GI[1] is applied to the gate electrode of the fourth transistor T14 through the second scanning line GI1 to turn on the fourth transistor T14. The first reset power supply line Vin1 is connected to the gate electrode of the first transistor T11 through the turned-on fourth transistor T14 to reset the first transistor T11.

At time t3, an enable-level first scanning signal GW[1] is applied to the gate electrodes of the second transistor T12 and the third transistor T13 through the first scanning line GW1 to turn on the second transistor T12 and the third transistor T13. A data voltage corresponding to the first pixel PX1 is applied to a second electrode of the first capacitor Cst1 through the turned-on second transistor T12 to charge a voltage difference between the data voltage and the driving voltage in the first capacitor Cst1. The gate electrode and the drain electrode of the first transistor T11 are connected to each other by the turned-on third transistor T13 to diode-connect the first transistor T11.

An enable-level fifth scanning signal GI[2] is applied to the gate electrode of the eleventh transistor T24 through the fifth scanning line GI2 to turn on the eleventh transistor T24. The first reset power supply line Vin1 is connected to the gate electrode of the eighth transistor T21 through the turned-on eleventh transistor T24 to reset the eighth transistor T21.

At time t4, an enable-level second scanning signal GW[2] is applied to the gate electrodes of the ninth transistor T22 and the tenth transistor T23 through the fourth scanning line GW2 to turn on the ninth transistor T22 and the tenth transistor T23. A data voltage corresponding to the second pixel PX2 is applied to the second electrode of the second capacitor Cst2 through the turned-on ninth transistor T22 to charge the voltage difference between the data voltage and the driving voltage in the second capacitor Cst2. The gate electrode and the drain electrode of the eighth transistor T21 are connected to each other by the turned-on tenth transistor T23 to diode-connect the ninth transistor T21.

At time t5, an enable-level third scanning signal GB[12] is applied to the gate electrodes of the seventh transistor T17 and the fourteenth transistor T27 through the third scanning line GB12 to turn on the seventh transistor T17 and the fourteenth transistor T27. The second reset power supply line Vint is connected to the first electrode of the first organic light emitting diode OLED1 through the turned-on seventh transistor T17, and the first electrode of the first organic light emitting diode (OLED1) is reset.

The second reset power supply line Vin2 is connected to the first electrode of the second organic light emitting diode OLED2 through the turned-on fourteenth transistor T27, and the first electrode of the second organic light emitting diode (OLED2) is reset.

At time t6, an enable-level first emission control signal EM[1] is applied to the fifth transistor T15 and the sixth transistor T16 to turn on the fifth transistor T15 and the sixth transistor T16. A path for connecting the common power supply line (ELVSS) is formed from the driving power supply line (ELVDD) through the turned-on fifth transistor T15 and sixth transistor T16. A driving current Id1 corresponding to the voltage charged in the first capacitor Cst1 flows to the first organic light emitting diode OLED1 through the formed path, and the first organic light emitting diode OLED1 emits light.

An enable-level second emission control signal EM[2] is applied to the twelfth transistor T25 and the thirteenth transistor T26 to turn on the twelfth transistor T25 and the thirteenth transistor T26. A path for connecting the common power supply line (ELVSS) is formed from the driving power supply line (ELVDD) through the turned-on twelfth transistor T25 and thirteenth transistor T26. A driving current Id2 corresponding to the voltage charged in the second capacitor Cst2 flows to the second organic light emitting diode (OLED2) through the formed path, and the second organic light emitting diode (OLED2) emits light.

Figure 6:
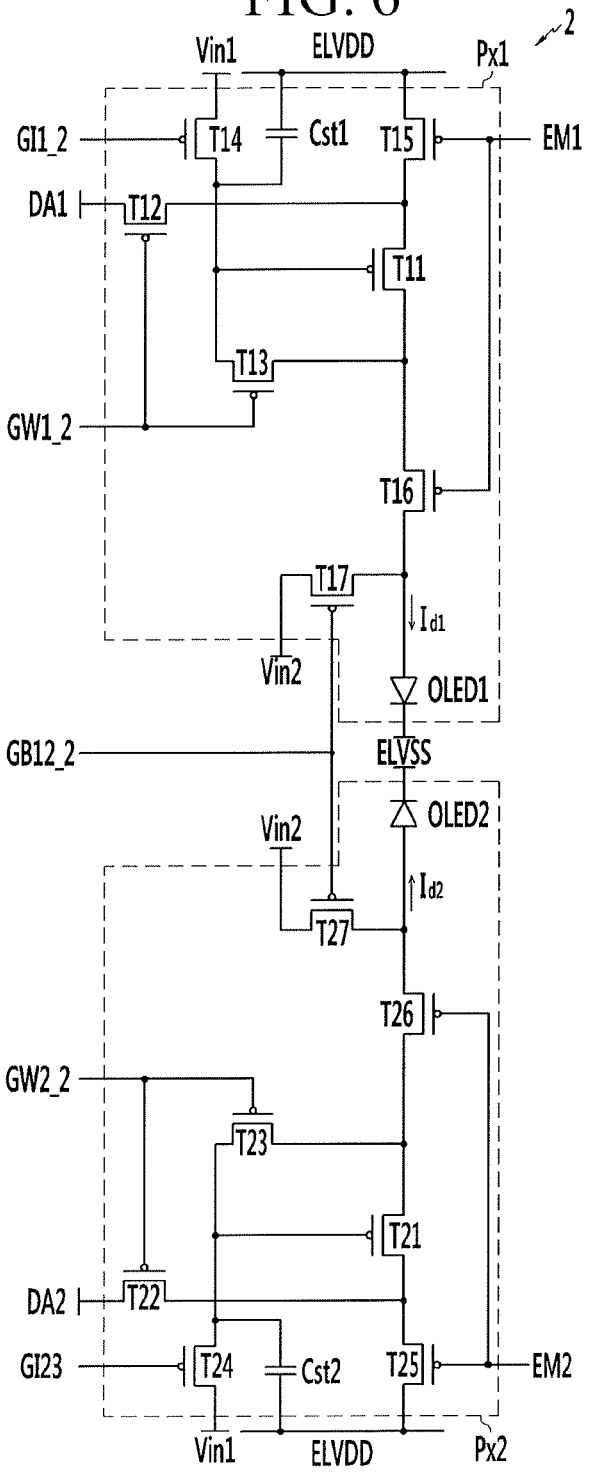
FIG. 6 illustrates another embodiment of a pixel circuit.
Figure 7:
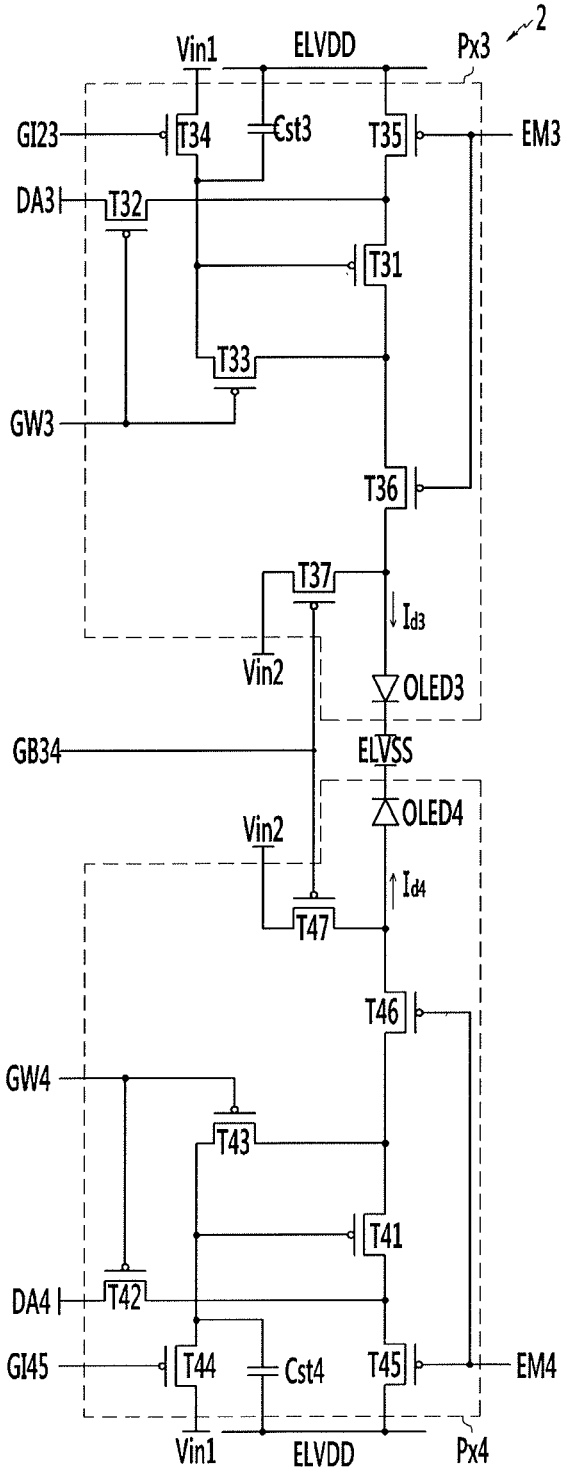
FIG. 7 illustrates an example of control signals for the pixel circuit in FIG. 6.

FIGS. 6 and 7 illustrate another embodiment of a pixel circuit 2 which includes a first pixel PX1 to a fourth pixel PX4. Compared to the pixel circuit 1 in FIG. 1, the pixel circuit 2 has a different configuration for the third pixel PX3 and the fourth pixel PX4 that shares a twelfth scanning line GB34.

Referring to FIG. 6, the first pixel PX1 includes a plurality of transistors T11, T12, T13, T14, T15, T16, and T17, a plurality of wires GW1, GI1, GB12, EM1, Vin1, Vin2, DA1, and ELVDD selectively connected to the transistors T11, T12, T13, T14, T15, T16, and T17, a first capacitor Cst1, and a first organic light emitting diode (OLED1).

The first pixel PX1 may correspond to first pixel PX1 in FIG. 1.

The second pixel PX2 includes a plurality of transistors, a plurality of wires selectively connected to the transistors, a second capacitor Cst2, and a second organic light emitting diode OLED2. The transistors include an eighth transistor T21, a ninth transistor T22, a tenth transistor T23, an eleventh transistor T24, a twelfth transistor T25, a thirteenth transistor T26, and a fourteenth transistor T27.

The eighth transistor T21, the ninth transistor T22, the tenth transistor T23, the twelfth transistor T25, the thirteenth transistor T26, the fourteenth transistor T27, the second capacitor Cst2, and the second organic light emitting diode OLED2 may correspond to those in FIG. 1.

The eleventh transistor T24 includes a gate electrode connected to a tenth scanning line GI23, a source electrode connected to the first reset power supply line Vin1, and a drain electrode connected to the gate electrode of the eighth transistor T21.

The wires include a ninth scanning line GW2_2 for transmitting a fourth scanning signal to the gate electrode of the ninth transistor T22 and the gate electrode of the tenth transistor T23, a tenth scanning line GI23 for transmitting a fifth scanning signal to the gate electrode of the eleventh transistor T24, an eighth scanning line GB12_2 for transmitting a third scanning signal to the gate electrode G17 of the fourteenth transistor T27, a second emission control line EM2 for transmitting a second emission control signal to the gate electrode of the twelfth transistor T25 and the gate electrode G26 of the thirteenth transistor T26, and a data line DA2 for transmitting a data signal to the source electrode of the ninth transistor T22.

The wires also include a driving power supply line (ELVDD) for supplying a driving signal to the first electrode of the second capacitor Cst2 and the source electrode of the twelfth transistor T25, a first reset power supply line Vin1 for supplying a first reset signal to the source electrode of the eleventh transistor T24, and a second reset power supply line Vin2 for supplying a second reset signal to the drain electrode D27 of the fourteenth transistor T27.

Referring to FIG. 7, the third pixel PX3 includes a plurality of transistors, a plurality of wires selectively connected to the transistors, a third capacitor Cst3, and a third organic light emitting diode OLED3. The transistors T31, T32, T33, T34, T35, 136, and T37 include a fifteenth transistor T31, a sixteenth transistor T32, a seventeenth transistor T33, an eighteenth transistor T34, a nineteenth transistor 135, a twentieth transistor T36, and a twenty-first transistor T37.

The fifteenth transistor T31 includes a gate electrode connected to a drain electrode of the seventeenth transistor T33 and a drain electrode of the eighteenth transistor T34, a source electrode connected to a drain electrode of the sixteenth transistor T32 and a drain electrode of the nineteenth transistor T35, and a drain electrode connected to a source electrode of the seventeenth transistor T33 and a source electrode of the twentieth transistor T36.

The sixteenth transistor T32 includes a gate electrode connected to a sixth scanning line GW1_2, a source electrode connected to a data line DA3, and a drain electrode connected to a source electrode of the fifteenth transistor T31.

The seventeenth transistor T33 includes a gate electrode connected to the sixth scanning line GW1_2, a source electrode connected to the drain electrode of the fifteenth transistor T31, and a drain electrode connected to the gate electrode of the fifteenth transistor T31.

The eighteenth transistor T34 includes a gate electrode connected to the seventh scanning line GI1_2, a source electrode connected to the first reset power supply line Vin1, and a drain electrode connected to the gate electrode of the fifteenth transistor T31.

The nineteenth transistor T35 includes a gate electrode connected to the third emission control line EM3, a source electrode connected to the driving power supply line (ELVDD), and a drain electrode connected to the source electrode of the fifteenth transistor T31.

The twentieth transistor T36 includes a gate electrode connected to the third emission control line EM3, a source electrode connected to the drain electrode of the fifteenth transistor T31, and a drain electrode connected to the source electrode of the twenty-first transistor T37.

The twenty-first transistor T37 includes a gate electrode connected to an eighth scanning line GB12_2, a source electrode connected to a first electrode of a third organic light emitting diode (OLED3), and a drain electrode connected to the second reset power supply line Vin2.

The wires include an eleventh scanning line GW3 for transmitting a first scanning signal to the gate electrode of the sixteenth transistor T32 and the gate electrode of the seventeenth transistor T33, a tenth scanning line GI23 for transmitting a second scanning signal to the gate electrode of the eighteenth transistor T34, a twelfth scanning line GB34 for transmitting a third scanning signal to the gate electrode G17 of the twenty-first transistor T37, a third emission control line EM3 for transmitting a first emission control signal to the gate electrode of the nineteenth transistor T35 and the gate electrode of the twentieth transistor T36, and a data line DA3 for transmitting a data signal to the source electrode of the sixteenth transistor T32.

The wires also include a driving power supply line (ELVDD) for supplying a driving signal to the first electrode of the third capacitor Cst3 and the source electrode of the nineteenth transistor T35, a first reset power supply line Vin1 for supplying a first reset signal to the source electrode of the eighteenth transistor T34, and a second reset power supply line Vin2 for supplying a second reset signal to the drain electrode D17 of the twenty-first transistor T37.

The third capacitor Cst3 includes a first electrode connected to the driving power supply line (ELVDD), and a second electrode connected to the gate electrode of the fifteenth transistor T31 and the drain electrode of the eighteenth transistor T34.

The third organic light emitting diode OLED3 includes a first electrode, a second electrode, and an organic emission layer between the first electrode and the second electrode. The third organic light emitting diode OLED3 includes a first electrode connected to the source electrode of the twenty-first transistor T37 and the drain electrode of the twentieth transistor T36, and a second electrode connected to the common power supply line (ELVSS) for transmitting a common signal.

The fourth pixel PX4 includes a plurality of transistors, a plurality of wires selectively connected to the transistors, a fourth capacitor Cst4, and a fourth organic light emitting diode (OLED4). The transistors include a twenty-second transistor T41, a twenty-third transistor T42, a twenty-fourth transistor T43, a twenty-fifth transistor T44, a twenty-sixth transistor T45, a twenty-seventh transistor T46, and a twenty-eighth transistor T47.

The twenty-second transistor T41 includes a gate electrode connected to a drain electrode of the twenty-fourth transistor T43 and a drain electrode of the twenty-fifth transistor T44, a source electrode connected to a drain electrode of the twenty-sixth transistor T45 and a drain electrode of the twenty-third transistor T42, and a drain electrode connected to a source electrode of the twenty-fourth transistor T43 and a source electrode of the twenty-seventh transistor T46.

The twenty-third transistor T42 includes a gate electrode connected to the thirteenth scanning line GW4, a source electrode connected to the data line DA4, and a drain electrode connected to the source electrode of the twenty-second transistor T41.

The twenty-fourth transistor T43 includes a gate electrode connected to the thirteenth scanning line GW4, a source electrode connected to the drain electrode of the twenty-second transistor T41, and a drain electrode connected to the gate electrode of the twenty-second transistor T41.

The twenty-fifth transistor T44 includes a gate electrode connected to the fourteenth scanning line G145, a source electrode connected to the first reset power supply line Vin1, and a drain electrode connected to the gate electrode of the twenty-second transistor T41.

The twenty-sixth transistor T45 includes a gate electrode connected to the fourth emission control line EM4, a source electrode connected to the driving power supply line (ELVDD), and a drain electrode connected to the source electrode of the twenty-second transistor T41.

The twenty-seventh transistor T46 includes a gate electrode connected to the fourth emission control line EM4, a source electrode connected to the drain electrode of the twenty-second transistor T41, and a drain electrode connected to the source electrode S17 of the twenty-eighth transistor T47.

The twenty-eighth transistor T47 includes a gate electrode G17 connected to the twelfth scanning line GB34, a source electrode connected to a first electrode of the fourth organic light emitting diode (OLED4), and a drain electrode connected to the second reset power supply line Vin2.

The wires include a thirteenth scanning line GW4 for transmitting a fourth scanning signal to the gate electrode of the twenty-third transistor T42 and the gate electrode of the twenty-fourth transistor T43, a fourteenth scanning line G145 for transmitting a fifth scanning signal to the gate electrode of the twenty-fifth transistor T44, a twelfth scanning line GB34 for transmitting a third scanning signal to the gate electrode of the twenty-eighth transistor T47, a fourth emission control line EM4 for transmitting a fourth emission control signal to the gate electrode of the twenty-sixth transistor T45 and the gate electrode of the twenty-seventh transistor T46, and a data line DA4 for transmitting a data signal to the source electrode of the twenty-third transistor T42.

The wires also include a driving power supply line (ELVDD) for supplying a driving signal to the first electrode of the fourth capacitor Cst4 and the source electrode of the twenty-sixth transistor T45, a first reset power supply line Vin1 for supplying a first reset signal to the source electrode of the twenty-fifth transistor T44, and a second reset power supply line Vin2 for supplying a second reset signal to the drain electrode D27 of the twenty-eighth transistor T47.

The fourth capacitor Cst4 includes a first electrode connected to the driving power supply line (ELVDD), and a second electrode connected to the gate electrode of the twenty-second transistor T41 and the drain electrode of the twenty-fourth transistor T43.

The fourth organic light emitting diode OLED4 includes a first electrode, a second electrode, and an organic emission layer between the first electrode and the second electrode. The fourth organic light emitting diode OLED4 includes a first electrode connected to the source electrode of the twenty-eighth transistor T47 and the drain electrode D26 of the twenty-seventh transistor T46, and a second electrode connected to the common power supply line (ELVSS) for transmitting a common signal.

Therefore, the first pixel PX1 and the second pixel PX2 share the eighth scanning line GB12_2, and the second the pixel PX2 and the third pixel PX3 share the tenth scanning line GI23. The first to fourth pixels PX1-PX4 may be driven by eight scanning lines GW1, GI1, GB12, GW2, G123, GW3, GB34, and GW4.

Figure 8:
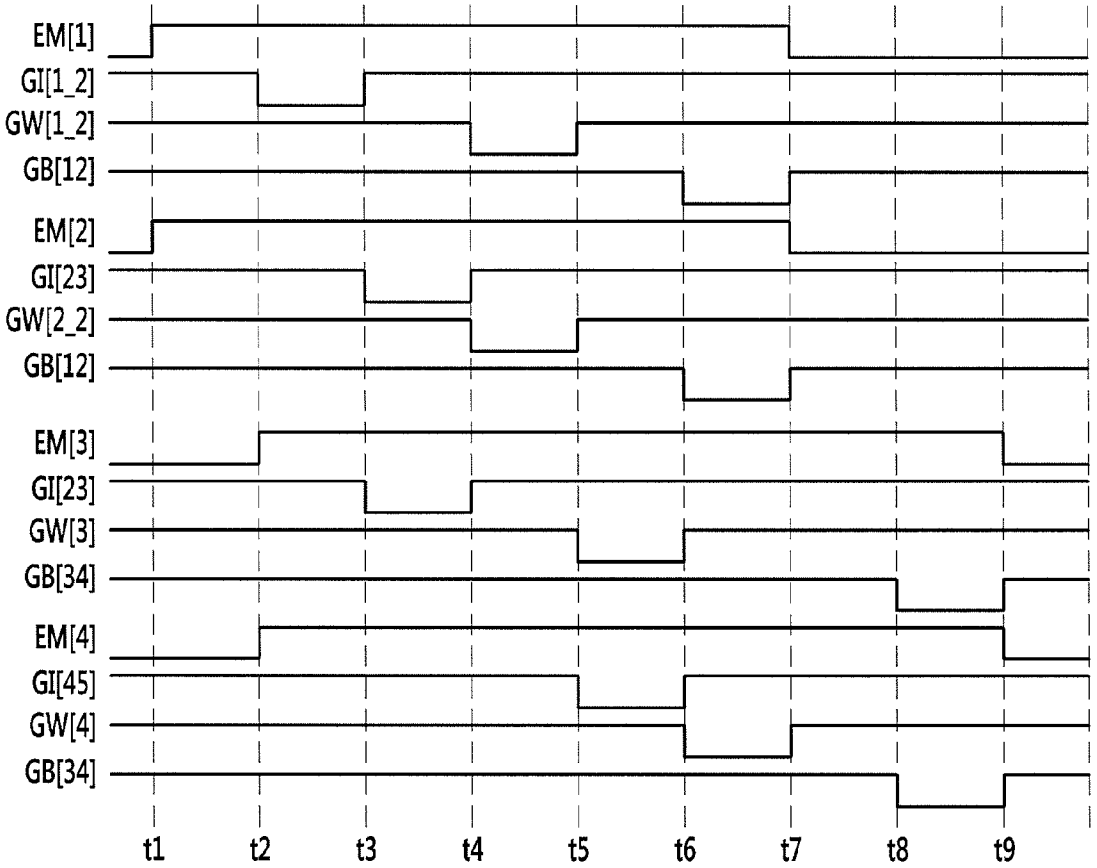
FIG. 8 is an example of a timing diagram for the pixel circuit in FIGS. 6 and 7.

FIG. 8 is an example of a driving timing diagram for the pixel circuit 2 in FIGS. 6 and 7. At time t1, a disable-level first emission control signal EM[1] is applied to the fifth transistor T15 and the sixth transistor T16 to turn off the fifth transistor T15 and the sixth transistor T16. The disable-level second emission control signal EM[2] is applied to the twelfth transistor T25 and the thirteenth transistor T26 to turn off the twelfth transistor T25 and the thirteenth transistor T26.

At time t2, a disable-level third emission control signal EM[3] is applied to the nineteenth transistor T35 and the twentieth transistor T36 to turn off the nineteenth transistor T35 and the twentieth transistor T36. The disable-level fourth emission control signal EM[4] is applied to the twenty-sixth transistor T45 and the twenty-seventh transistor T46 to turn off the twenty-sixth transistor T45 and the twenty-seventh transistor T46.

At the time t2, an enable-level seventh scanning signal GI[1_2] is applied to the gate electrode of the fourth transistor 114 through the seventh scanning line GI1_2 to turn on the fourth transistor T14. A first reset power is applied to the gate electrode of the first transistor T11 through the turned-on fourth transistor T14 to reset the first transistor T11.

At time t3, an enable-level tenth scanning signal GI[23] is applied to the gate electrodes of the eleventh transistor T24 and the eighteenth transistor T34 through the tenth scanning line GI23 to turn on the eleventh transistor T24 and the eighteenth transistor T34.

The first reset power supply line Vin1 is connected to the gate electrode of the eighth transistor T21 through the turned-on eleventh transistor T24 to reset the eighth transistor T21. The first reset power supply line Vin1 is connected to the gate electrode of the fifteenth transistor T31 through the turned-on eighteenth transistor T34 to reset the fifteenth transistor T31.

At time t4, an enable-level sixth scanning signal GW[1_2] is applied to the gate electrodes of the second transistor T12 and the third transistor T13 through the sixth scanning line GW1_2 to turn on the second transistor T12 and the third transistor T13. A data voltage corresponding to the first pixel PX1 is applied to the second electrode of the first capacitor Cst1, through the turned-on second transistor T12, to charge the voltage difference between the data voltage and the driving voltage in the first capacitor Cst1. The gate electrode and the drain electrode of the first transistor T11 are connected to each other by the turned-on third transistor T13 to diode-connect first transistor T11.

An enable-level ninth scanning signal GW[2_2] is applied to the gate electrodes of the ninth transistor 122 and the tenth transistor T23 through the ninth scanning line GW2_2 to turn on the ninth transistor T22 and the tenth transistor T23. A data voltage corresponding to the second pixel PX2 is applied to the second electrode of the second capacitor Cst2, through the turned-on ninth transistor T22, to charge the voltage difference between the data voltage and the driving voltage in the second capacitor Cst2. The gate electrode and the drain electrode of the eighth transistor T21 are connected to each other by the turned-on tenth transistor T23 to diode connect eighth transistor T21.

At time t5, an enable-level eleventh scanning signal GW[3] is applied to the gate electrodes of the sixteenth transistor T32 and the seventeenth transistor T33, through the eleventh scanning line GW3, to turn on the sixteenth transistor T32 and the seventeenth transistor T33. A data voltage corresponding to the third pixel PX3 is applied to the second electrode of the third capacitor Cst3, through the turned-on sixteenth transistor T32, to charge the voltage difference between the data voltage and the driving voltage in the third capacitor Cst3. The gate electrode and the drain electrode of the fifteenth transistor T31 are connected to each other by the turned-on seventeenth transistor T33 to diode connect the fifteenth transistor T31.

An enable-level fourteenth scanning signal GI[45] is applied to the gate electrode of the twenty-fifth transistor T44, through the fourteenth scanning line G145, to turn on the twenty-fifth transistor T44. The first reset power supply line Vin1 is connected to the gate electrode of the twenty-second transistor T41, through the turned-on twenty-fifth transistor T44, to reset the twenty-second transistor T41.

At time t6, an enable-level eighth scanning signal GB[12] is applied to the gate electrodes of the seventh transistor T17 and the fourteenth transistor T27, through the eighth scanning line GB122, to turn on the seventh transistor T17 and the fourteenth transistor T27. The second reset power supply line Vin2 and the first electrode of the first organic light emitting diode OLED1 are connected to each other through the turned-on seventh transistor T17, and the first electrode of the first organic light emitting diode OLED1 is reset. The second reset power supply line Vin2 and the first electrode of the second organic light emitting diode OLED2 are connected to each other through the turned-on fourteenth transistor T27, and the first electrode of the second organic light emitting diode OLED2 is reset.

An enable-level thirteenth scanning signal GW[4] is applied to the gate electrodes of the twenty-third transistor T42 and the twenty-fourth transistor T43, through the thirteenth scanning line GW4, to turn on the twenty-third transistor T42 and the twenty-fourth transistor T43. A data voltage corresponding to the fourth pixel PX4 is applied to the second electrode of the fourth capacitor Cst4, through the turned-on twenty-third transistor T42, to charge the voltage difference between the data voltage and the driving voltage in the fourth capacitor Cst4. The gate electrode and the drain electrode of the twenty-second transistor T41 are connected to each other by the turned-on twenty-fourth transistor T43 to diode-connect the twenty-second transistor T41.

At time t7, an enable-level first emission control signal EM[1] is applied to the fifth transistor T15 and the sixth transistor T16 to turn on the fifth transistor T15 and the sixth transistor T16. A path for connecting the common power supply line (ELVSS) is formed from the driving power supply line (ELVDD) through the turned-on fifth transistor T15 and sixth transistor T16. A driving current Id1 corresponding to the voltage charged in the first capacitor Cst1 flows to the first organic light emitting diode OLED1 through the formed path, and the first organic light emitting diode OLED1 emits light.

An enable-level second emission control signal EM[2] is applied to the twelfth transistor T25 and the thirteenth transistor T26 to turn on the twelfth transistor T25 and the thirteenth transistor T26. A path for connecting the common power supply line (ELVSS) is formed from the driving power supply line (ELVDD) through the turned-on twelfth transistor T25 and thirteenth transistor T26. A driving current Id2 corresponding to the voltage charged in the second capacitor Cst2 flows to the second organic light emitting diode OLED2 through the formed path, and the second organic light emitting diode OLED2 emits light.

At time t8, an enable-level twelfth scanning signal GB[34] is applied to the gate electrodes of the twenty-first transistor T37 and the twenty-eighth transistor T47, through the twelfth scanning line GB34, to turn on the twenty-first transistor T37 and the twenty-eighth transistor T47. The second reset power supply line Vin2 and the first electrode of the third organic light emitting diode OLED3 are connected to each other, through the turned-on twenty-first transistor T37, to reset the first electrode of the third organic light emitting diode OLED3. The second reset power supply line Vin2 and the first electrode of the fourth organic light emitting diode OLED4 are connected to each other through the turned-on twenty-eighth transistor T47, and the first electrode of the fourth organic light emitting diode OLED4 is reset.

At time t9, an enable-level third emission control signal EM[3] is applied to the nineteenth transistor T35 and the twentieth transistor T36 to turn on the nineteenth transistor T20 and the twentieth transistor T36. A path for connecting the common power supply line (ELVSS) is formed from the driving power supply line (ELVDD) through the turned-on nineteenth transistor T20 and twentieth transistor T36. A driving current Id3 corresponding to the voltage charged in the third capacitor Cst3 flows to the third organic light emitting diode OLED3 through the formed path, and the third organic light emitting diode OLED3 emits light.

An enable-level fourth emission control signal EM[4] is applied to the twenty-sixth transistor T45 and the twenty-seventh transistor T46 to turn on the twenty-sixth transistor T45 and the twenty-seventh transistor T46. A path for connecting the common power supply line (ELVSS) is formed from the driving power supply line (ELVDD) through the turned-on twenty-sixth transistor T45 and twenty-seventh transistor T46. A driving current Id4 corresponding to the voltage charged in the fourth capacitor Cst4 flows to the fourth organic light emitting diode OLED4 through the formed path, and the fourth organic light emitting diode (OLED4) emits light.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. A pixel circuit, comprising:

a first pixel which includes:

a first transistor to allow a first current corresponding to a voltage between a control electrode and a second electrode thereof to flow to a first electrode thereof, the second electrode connected to a first power;

a first light-emitting device including a first terminal connected to the first electrode of the first transistor and a second terminal connected to a second power, the first light-emitting device to emit light based on the first current; and a second transistor including a control electrode connected to a first scanning line, a second electrode connected to the first terminal of the first light-emitting device, and a first electrode connected to a first reset power; and a second pixel which includes:

a third transistor to allow a second current corresponding to a voltage between a control electrode and a second electrode thereof to flow to a first electrode thereof, the second electrode connected to the first power;

a second light-emitting device including a first terminal connected to the first electrode of the third transistor and a second terminal connected to the second power, the second light-emitting device to emit light based on the second current; and a fourth transistor including a control electrode connected to the first scanning line, a second electrode connected to the first terminal of the second light-emitting device, and a first electrode connected to the first reset power.

2. The pixel circuit as claimed in claim 1, wherein:

the first pixel includes a fifth transistor including a control electrode connected to a second scanning line, a second electrode connected to the control electrode of the first transistor, and a first electrode connected to a second reset power, and the second pixel includes a sixth transistor including a control electrode connected to a third scanning line, a second electrode connected to the control electrode of the third transistor, and a first electrode connected to the second reset power.

3. The pixel circuit as claimed in claim 2, wherein the second scanning line of the first pixel is connected to the third scanning line of the second pixel.

4. The pixel circuit as claimed in claim 3, wherein the first pixel includes:

a seventh transistor including a control electrode connected to a fourth scanning line, a second electrode connected to a corresponding data line, and a first electrode connected to the second electrode of the first transistor; and an eighth transistor including a control electrode connected to the fourth scanning line, a second electrode connected to the control electrode of the first transistor, and a first electrode connected to the first electrode of the first transistor, and wherein the second pixel includes:

a ninth transistor including a control electrode connected to a fifth scanning line, a second electrode connected to a corresponding data line, and a first electrode connected to the second electrode of the third transistor; and a tenth transistor including a control electrode connected to the fifth scanning line, a second electrode connected to the control electrode of the third transistor, and a first electrode connected to the first electrode of the third transistor.

5. A method for driving a pixel circuit as claimed in claim 1, the method comprising:

applying a first scanning signal to the first scanning line;

applying the first reset power to the first terminal of the first light-emitting device; and applying the first reset power to the first terminal of the second light-emitting device.

6. The method as claimed in claim 5, wherein:

the first pixel includes a fifth transistor including a control electrode connected to a third scanning line, a second electrode connected to the control electrode of the first transistor, and a first electrode connected to a second reset power, the second pixel includes a sixth transistor including a control electrode connected to the third scanning line, a second electrode connected to the control electrode of the third transistor, and a first electrode connected to the second reset power, and the method includes:

applying a third scanning signal to the third scanning line, applying the second reset power to the control electrode of the first transistor, and applying the second reset power to the control electrode of the third transistor.

7. An apparatus, comprising:

a first pixel including a first transistor to supply a first current corresponding to a voltage applied to a gate electrode of the first transistor to a first light emitter and a second transistor to connect the gate electrode of the first transistor to a first reset power;

a second pixel including a third transistor to supply a second current corresponding to a voltage applied to a gate electrode of the third transistor to a second light emitter and a fourth transistor to connect the gate electrode of the third transistor to the first reset power, the second and fourth transistors to be controlled by a same control signal; and a third pixel including a fifth transistor to supply a third current corresponding to a voltage applied to a gate electrode of the fifth transistor to a third light emitter and a sixth transistor to connect the third light emitter to a second reset power, wherein the second pixel further includes a seventh transistor to connect the second light emitter to the second reset power, and wherein the seventh transistor of the second pixel and the fifth transistor of the third pixel are controlled by a same scanning signal.

8. The apparatus as claimed in claim 7, wherein the same control signal is a first scanning signal.

9. The apparatus as claimed in claim 8, wherein the second and fourth transistors are connected to a same scanning line to receive the first scanning signal.

10. The apparatus as claimed in claim 7, wherein the voltage applied to the gate electrode of the first transistor and the voltage applied to the gate electrode of the third transistor are supplied to the first and second pixels at different periods, respectively.

11. An apparatus, comprising:

a first pixel including a first transistor to control current to a first light emitter and a second transistor to connect the first light emitter to a first reset power; and a second pixel including a third transistor to control current to a second light emitter and a fourth transistor to connect the second light emitter to the first reset power, the second and fourth transistors to be controlled by a first scanning signal, wherein the second and fourth transistors are connected to a same scanning line to receive the first scanning signal, and wherein:

the first pixel includes a fifth transistor to connect the first transistor to a second reset power and a sixth transistor to receive a first data signal, and the second pixel includes a seventh transistor to connect the third transistor to the second reset power and an eighth transistor to receive a second data signal, wherein the fifth transistor is to be controlled by a second scanning signal and the seventh transistor is to be controlled by a third scanning signal, and wherein the first scanning signal the second scanning signal, and the third scanning signal are applied at different times.

* * * * *